US007770507B1

(12) United States Patent
Hajjar et al.

(10) Patent No.: US 7,770,507 B1
(45) Date of Patent: Aug. 10, 2010

(54) METHOD AND APPARATUS FOR AN ACTION SYSTEM FOR A FIREARM

(75) Inventors: Jeffrey Hajjar, Boise, ID (US); Warren Stockton, Meridian, ID (US)

(73) Assignee: Snake River Machine, Inc., Meridian, ID (US)

( * ) Notice: Subject to any disclaimer, the term of this patent is extended or adjusted under 35 U.S.C. 154(b) by 887 days.

(21) Appl. No.: 11/505,689

(22) Filed: Aug. 17, 2006

Related U.S. Application Data

(63) Continuation-in-part of application No. 11/003,073, filed on Dec. 3, 2004, now Pat. No. 7,299,737.

(60) Provisional application No. 60/526,540, filed on Dec. 3, 2003.

(51) Int. Cl.
*F41A 3/44* (2006.01)

(52) U.S. Cl. ..... 89/188

(58) Field of Classification Search ..... 89/172, 89/174, 185, 188
See application file for complete search history.

(56) References Cited

U.S. PATENT DOCUMENTS 2,336,146 A 12/1943 Williams
2,736,117 A * 2/1956 Clarkson et al. ..... 42/75.02
3,407,702 A 10/1968 Cermak et al.
4,938,116 A 7/1990 Royster
5,682,007 A * 10/1997 Dobbins ..... 89/187.02
5,710,389 A 1/1998 Canaday
5,983,774 A 11/1999 Mihaita
6,079,138 A 6/2000 Meaker
6,530,306 B1 3/2003 LaFleur
6,588,312 B2 7/2003 Murello et al.
6,761,102 B2 7/2004 Giza
2003/0183068 A1 10/2003 LaFleur

* cited by examiner

*Primary Examiner*—Stephen M Johnson
(74) *Attorney, Agent, or Firm*—Factor & Lake, Ltd.

(57) ABSTRACT

A method and apparatus providing an action system for a semi-automatic shotgun including a receiver having an ejection port for expelling an empty cartridge of a fired projectile. The action system includes a bolt attached to a bolt carrier, wherein the bolt and the bolt carrier are movable within the receiver and substantially parallel to a longitudinal axis. A surface is attached to at least the bolt carrier or the receiver, and a roller is positioned rearward of the ejection port and proximate the surface, wherein a resistance is provided to rearward movement of at least the bolt or bolt carrier.

14 Claims, 16 Drawing Sheets

METHOD AND APPARATUS FOR AN ACTION SYSTEM FOR A FIREARM

RELATED APPLICATIONS

This application is a continuation-in-part that claims the benefit of U.S. patent application Ser. No. 11/003,073, filed Dec. 3, 2004, now U.S. Pat. No. 7,299,737; which claims the benefit of U.S. Provisional Patent App. No. 60/526,540, filed Dec. 3, 2003; the contents of which are expressly incorporated herein by reference.

TECHNICAL FIELD

The invention relates generally to the field of firearms, and more specifically to the operating system of a firearm.

BACKGROUND OF THE INVENTION

The roller-lock delayed blowback action system has been employed in rifles and sub-machine guns since the 1950's and is well known to those familiar with firearm design, but it has not previously been employed in a semi-automatic shotgun. This is likely because the large diameter of the cartridge would require a disproportionately bulky mechanism and would interfere with the space necessary for feeding and ejecting the cartridges when situated near the front of the bolt—as in all previous known designs. However, it is desirable to provide a roller-lock delayed blowback action system for a shotgun because it would offer an alternative to: gas-operated systems that are subject to fouling; recoil-operated systems that are notoriously unreliable; and straight blowback systems that require an undesirable heavy bolt.

Additionally, a firearm incorporating known delayed-blowback roller-lock action system generally uses the same size or type of ammunition. As such, utilizing a constant resistance to impede rearward movement of the bolt and/or bolt carrier works well. In contrast, employing a constant or fixed amount of rearward resistance for use in a shotgun that is capable of firing a wide range of ammunition sizes and types—e.g., 2¾ inch light target loads, 3 inch magnum slug loads, non-lethal projectiles—does not work as well. Thus, to accommodate the wide range of ammunition utilized in a semi-automatic shotgun, there is a need for a delayed roller-lock action system capable of providing a variable amount of resistance to rearward movement of the bolt and/or bolt carrier.

The present invention is provided to address these and other considerations.

SUMMARY OF THE INVENTION

The present invention is a roller-lock delayed blowback mechanism providing a compact, low-maintenance, reliable, and lightweight action system for a firearm, preferably a semi-automatic shotgun. A primary roller-lock mechanism is located to the rear of the feeding and ejecting ports of the firearm and preferably contained within the approximate diameter of a cartridge.

An alternative embodiment of the present invention further incorporates a secondary, or compounding, roller-lock mechanism within the action system to further delay the opening of the firearm chamber. This is advantageous because locating the locking rollers to the rear of the ejection port obviates the use of a relatively long and proportionately heavy bolt in which the rollers are caged. Thus, a relatively lighter bolt carrier—to be accelerated past inwardly pinching rollers—provides less inertial resistance to the accelerating force than prior conventional designs wherein the bolt carrier is proportionately larger, heavier, and more resistant to acceleration. That is, the reduced delaying effect of the primary roller-lock mechanism brought about by the necessarily diminished physical space requirements, has been increased by compounding the primary roller-lock mechanism rather than by adding mass. In the preferred embodiment, the inertia of a relatively lesser mass (the firing pin and striking hammer) sufficiently delays the opening of the firing chamber until the explosive pressure within is reduced to a safe level by retarding the movement of the bolt carrier relative to the bolt, which in turn retards the movement of the bolt relative to the barrel and receiver of the shotgun. The compounding or additional stage of roller-lock delay is increased similar in effect to compounding a 1:10 gear ratio to produce a 1:100 ratio.

A further aspect of the present invention is directed to an action system for a semi-automatic shotgun having a receiver including an ejection port for expelling an empty cartridge of a fired projectile. The action system includes a bolt attached to a bolt carrier, wherein the bolt and the bolt carrier are movable within the receiver and substantially parallel to a longitudinal axis. A surface is attached to the bolt carrier or the receiver, and, a roller is positioned rearward of the ejection port and proximate the surface.

Another further aspect of the present invention includes the surface having an arcuate geometry to provide a variable resistance to rearward movement of at least the bolt or bolt carrier. The surface can be at least a portion of an insert comprised of hardened steel and be removably attached to firearm's receiver, bolt, or bolt carrier.

Yet another further aspect of the present invention includes an action system for a semi-automatic shotgun having a receiver including an ejection port for expelling an empty cartridge of a fired projectile. The action system includes a bolt attached to a bolt carrier, wherein the bolt and the bolt carrier are movable within the receiver and substantially parallel to a longitudinal axis. The action system further includes a roller-lock assembly comprising a roller positioned rearward of the ejection port, and a pair of surfaces—an inner surface and an outer surface—positioned proximate the roller, wherein the roller and the pair of surfaces cooperate to provide a resistance to rearward movement of at least the bolt or bolt carrier. The action system may further include another roller-lock assembly, wherein the pair of roller-lock assemblies is symmetrically positioned about a longitudinal plane including the longitudinal axis.

A still further aspect of the present invention is directed to a method for delaying movement of a bolt in response to firing of the semi-automatic shotgun. The method includes: positioning a roller rearward of the ejection port; providing a resistance to rearward movement of the bolt in response to the firing of the semi-automatic shotgun; and, varying the resistance.

These and other aspects and attributes of the present invention will be discussed with reference to the following drawings and accompanying specification and claims.

DETAILED DESCRIPTION OF THE EMBODIMENT

Figure 1:
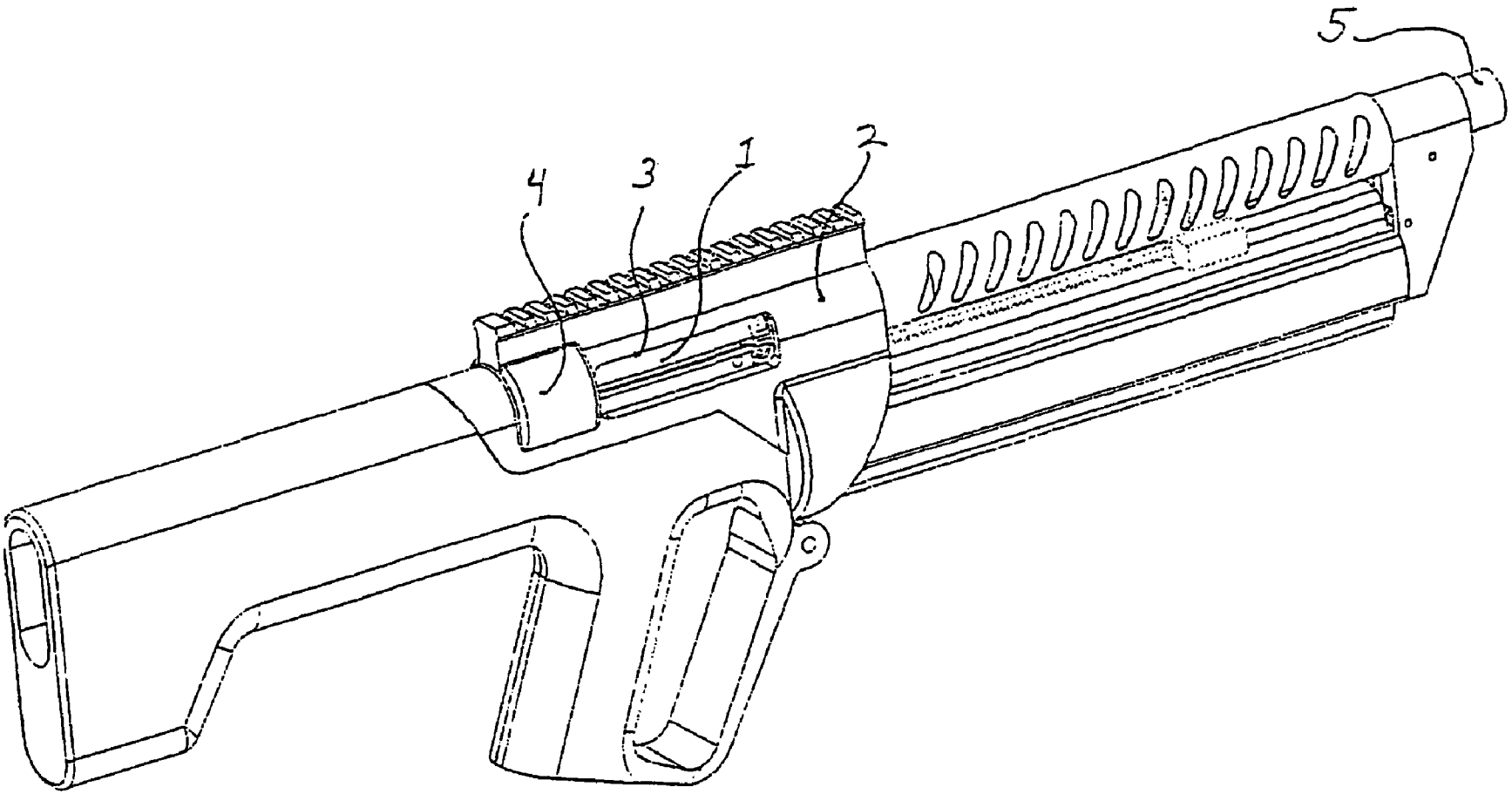
FIG. 1 is a perspective view of a semi-automatic shotgun.

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 depicts a semi-automatic shotgun having a roller-lock mechanism deployed within a reinforcing boss 4 on a receiver 2. A bolt 1 rides within the receiver 2 to close a firing chamber 20 in a barrel 5. The bolt 1 extends rearward past an ejection port 3 when out of battery position. It should be noted that in this and other figures, certain details of the firearm not related to the patentable aspects of the present invention—such as the trigger mechanism and magazine—are not enumerated.

Figure 2:
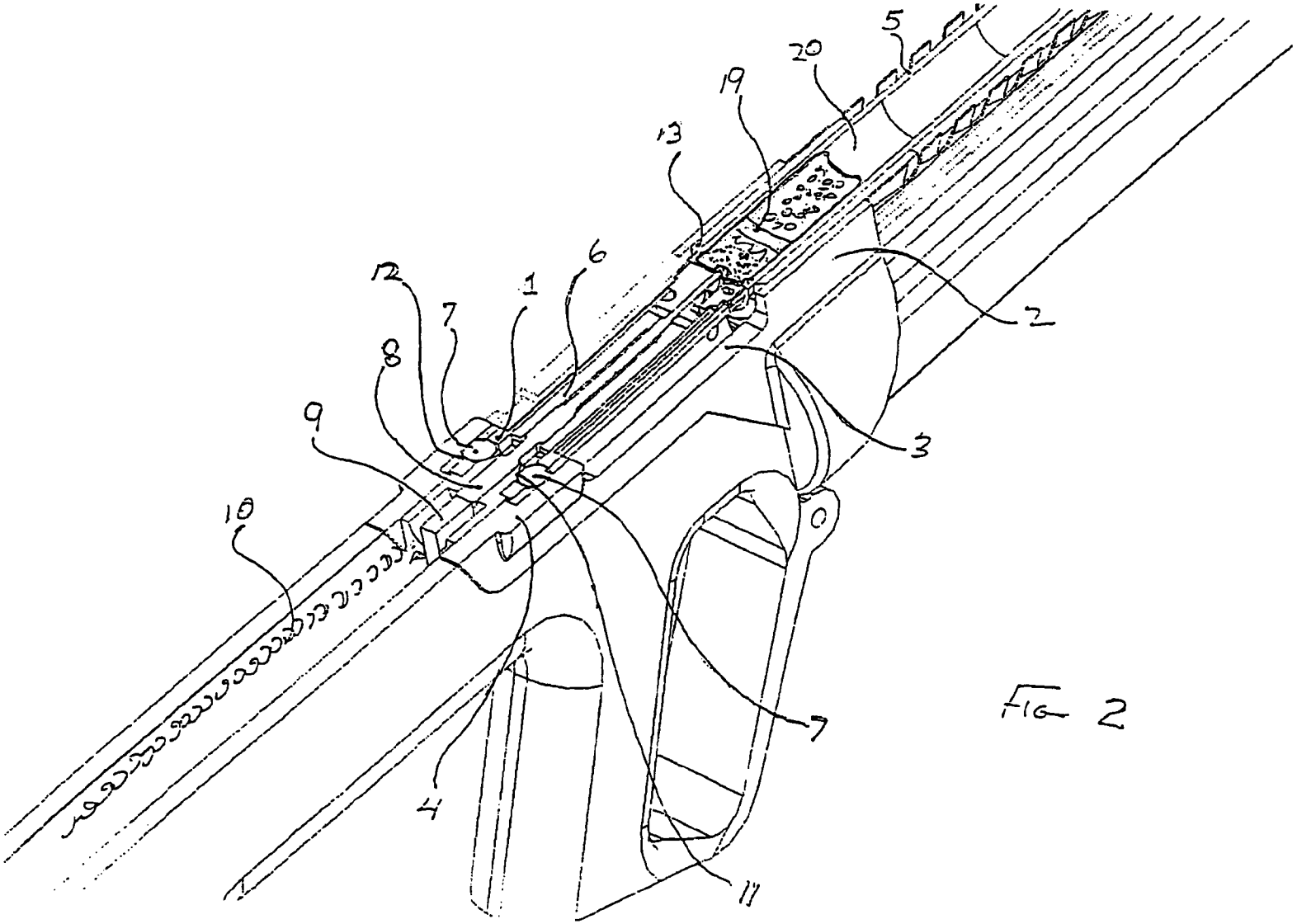
FIG. 2 is a partial horizontal cross-sectional view of the action system of the present invention.
Figure 6:
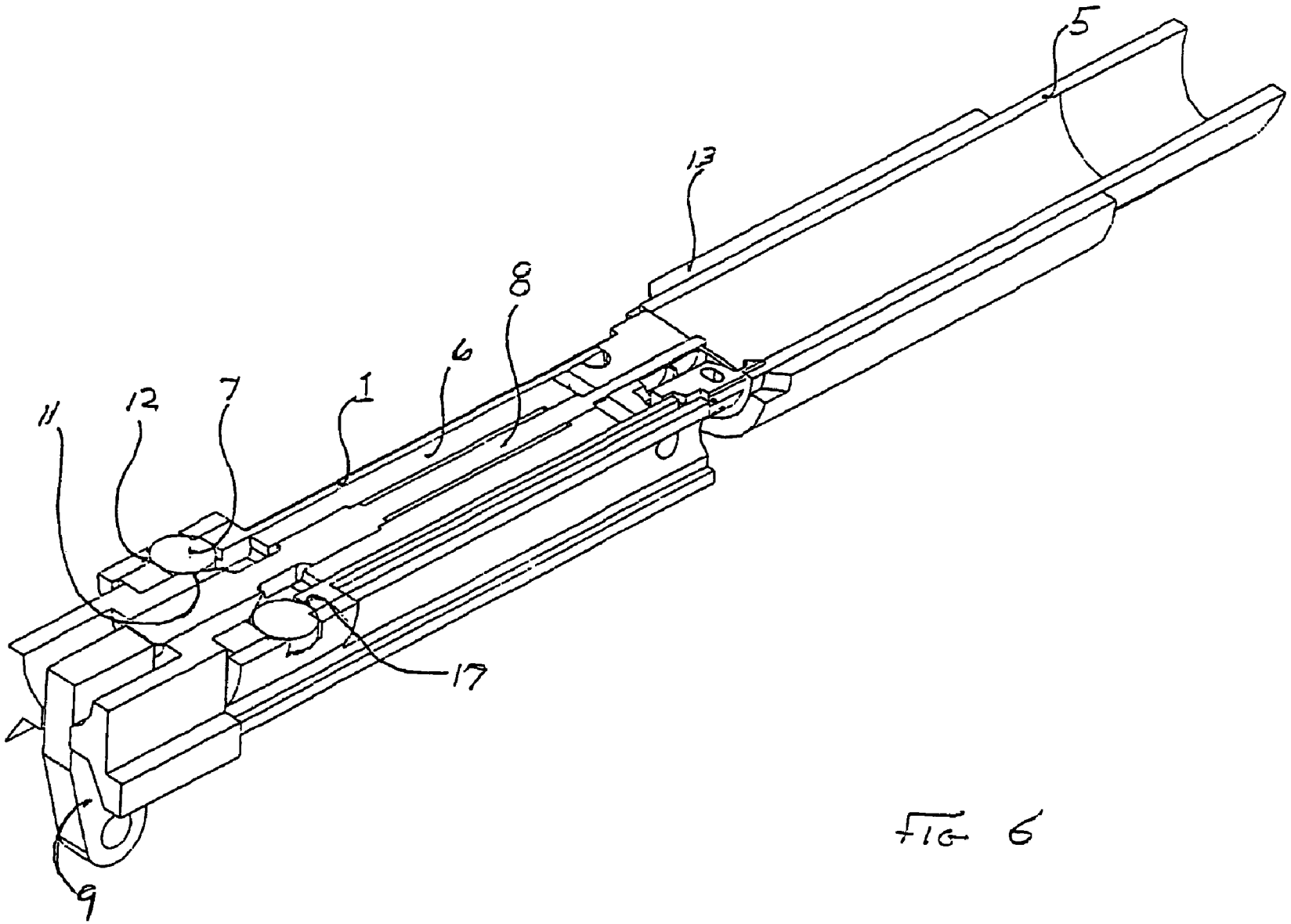
FIG. 6 is a partial perspective horizontal cross-sectional view of the action system of the present invention in battery position.

FIGS. 2 and 6 depict a partial horizontal cross-sectional view about the centerline of the firearm barrel 5 showing the primary roller-lock mechanism of one embodiment of the present invention. The primary roller-lock mechanism is positioned rearward of the ejection port 3 and preferably comprises the bolt 1, a bolt carrier 6, primary bearing(s) 7 (e.g., roller(s)), and a barrel extension 13. When the cartridge 19 is fired by a hammer 9 impinging on a firing pin 8, the explosive gas pressure in the firing chamber 20 forces the bolt 1—which cages the rollers 7—rearward; thus pinching the rollers between detents 12, e.g., angled ramps, in the fixed barrel extension 13 and detents 11, e.g., angled ramps, in the moveable bolt carrier 6. This results in the bolt carrier 6 being rapidly accelerated rearward past the inwardly pinching rollers 7 until the rollers 7 clear the fixed ramps 12 in the barrel extension 13 wherein the bolt 1 is free to travel rearward to eject the spent cartridge 19 through the ejection port 3 and compress the return spring 10.

At the terminus of its rearward travel within the receiver 2, the bolt 1 is impelled forward by the return spring 10 to pick up a new cartridge 19 and load it into the firing chamber 20. When the bolt 1 reaches its forward terminus (in battery), the return spring 10 and inertia continue to drive the bolt carrier 6 forward until its inclined ramps 11 have forced the rollers 7 outward against the inclined ramps 12 of the barrel extension 13, thus wedging the bolt 1 firmly in battery against the barrel 5. This primary roller-lock delay mechanism serves to delay the opening of the firing chamber 20 until the gas pressure is reduced to a predetermined, e.g., safe, level.

Because the delay effect of the primary roller-lock mechanism is chiefly dependant on the inertial resistance of the mass of the bolt carrier (6) and it is undesirable to increase that mass to augment the delay, an alternative embodiment of the present invention incorporates a secondary roller-lock mechanism within the bolt itself.

Figure 3:
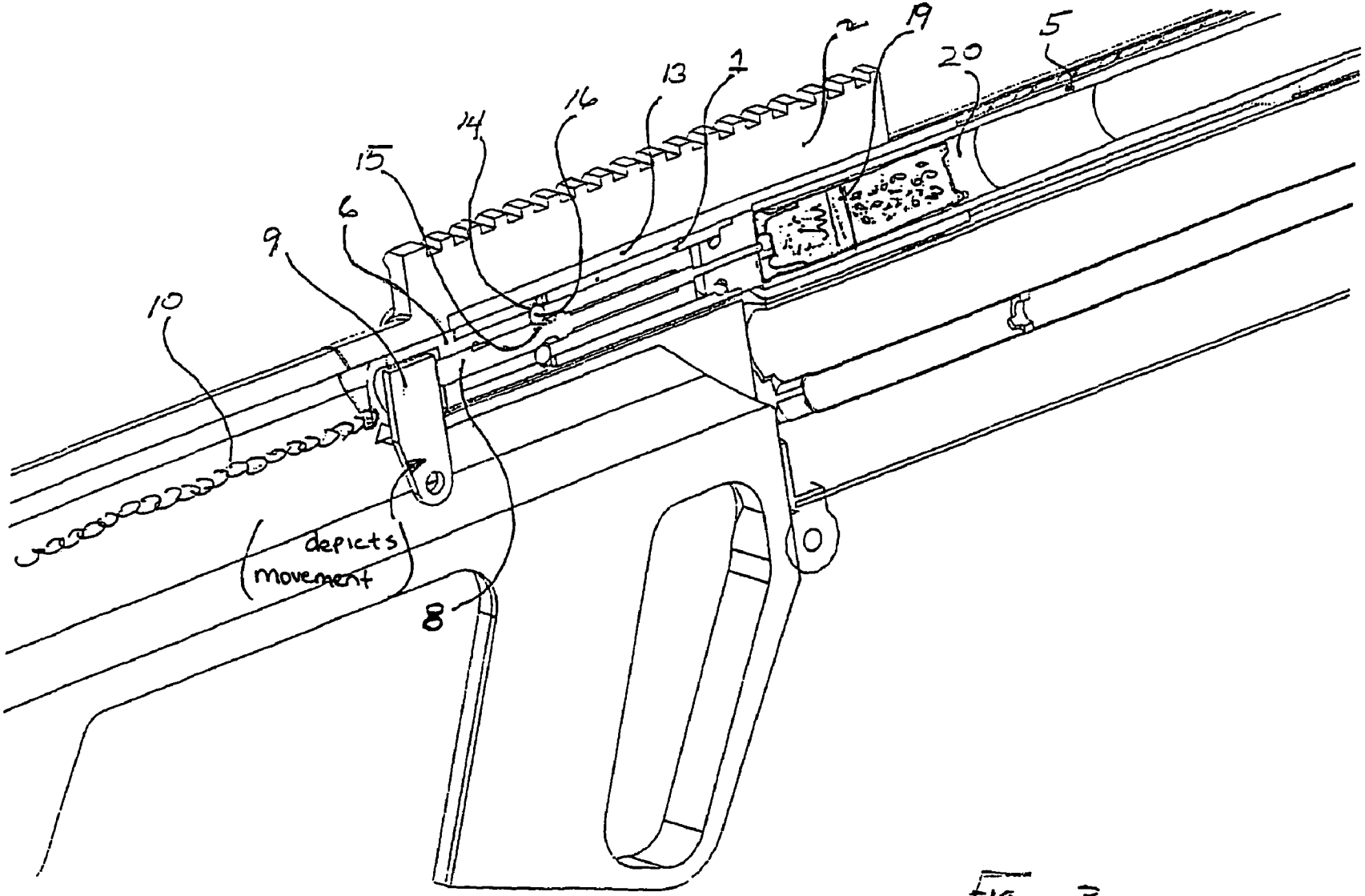
FIG. 3 is a partial vertical cross-sectional view of the action system of the present invention.
Figure 7:
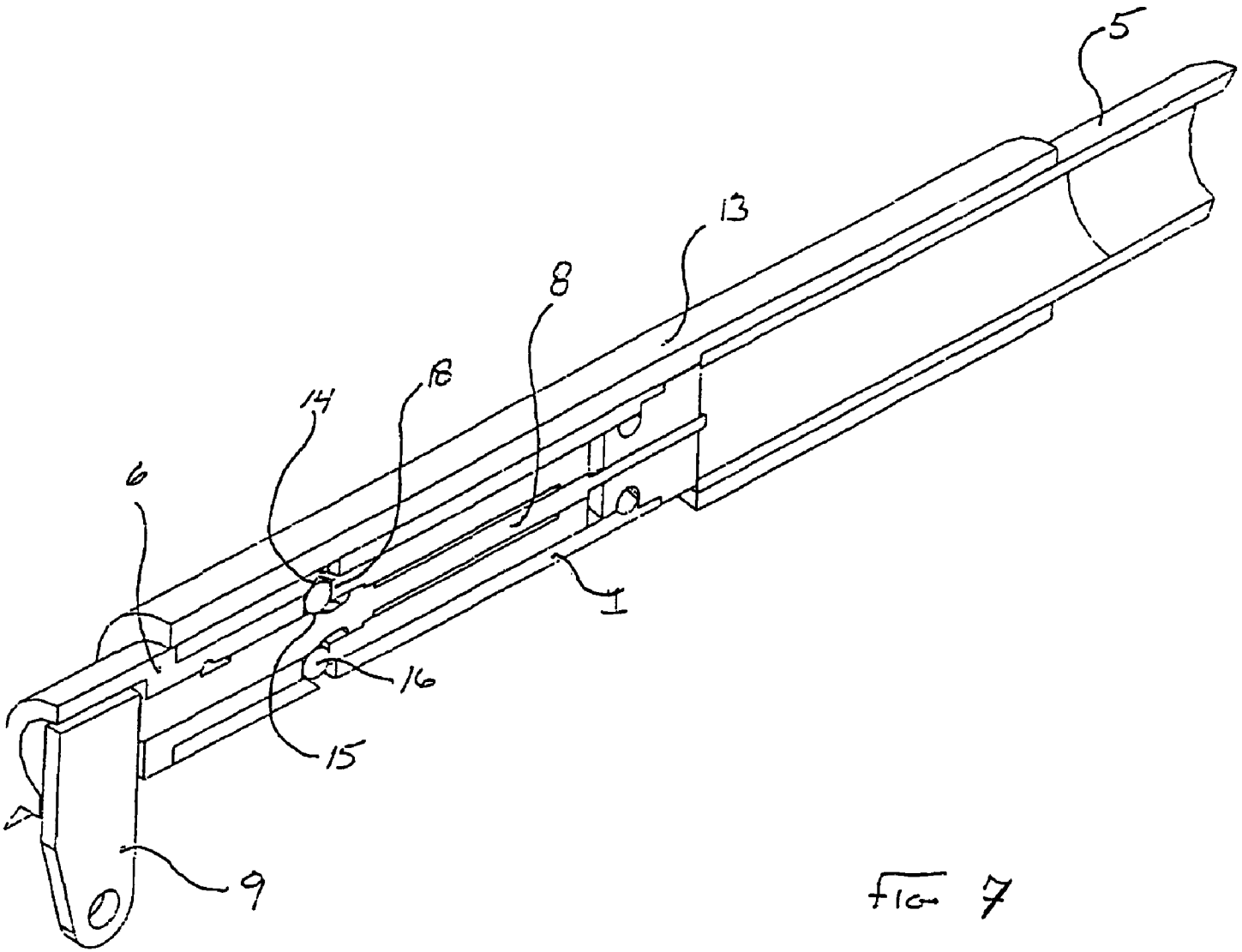
FIG. 7 is a partial perspective vertical cross-sectional view of the action system of the present invention in battery position; and, FIG. 8 is a perspective view of one embodiment of the present invention; and, FIG. 9 is a partial perspective cross-section view of an alternate embodiment of the present invention.

FIGS. 3 and 7 depict a partial vertical cross-sectional view of the secondary, or compounding, roller-lock mechanism comprising a secondary bearing 16, e.g., roller(s), caged within the bolt carrier 6 between detents 14, e.g., inclined ramps, in the bolt 1 and detents 15, e.g., inclined ramps, in the firing pin 8. When a striking hammer 9 is released by the trigger mechanism (not shown), it drives the firing pin 8 forward to ignite the cartridge 19. At the forward terminus of its 8 travel, angled ramps 15 in the firing pin 8 force the secondary rollers 16 caged in the bolt carrier 6 outward against the angled ramps 14 in the bolt 1—effectively wedging the bolt carrier 6 into the bolt 1. When the cartridge 19 is fired, the resulting gas pressure in the firing chamber 20 applies rearward force to the bolt 1. The bolt's movement is delayed by the primary roller-lock mechanism of FIG. 2 described above, and the bolt carrier 6 therein described is delayed from moving relative to the bolt 1 until the secondary rollers 16 caged within the bolt carrier 6 are pinched inward by the inclined ramps 14 in the bolt 1 against the inclined ramps 15 in the firing pin 8—thus accelerating the firing pin 8 rearward against the striking hammer 9. The result of this compounding mechanism is the relatively small inertial mass of the firing pin 8 and striking hammer 9 can effectively and securely delay the opening of the bolt 1 until the gas pressure in the firing chamber 20 has dropped to a safe level.

Figure 4:
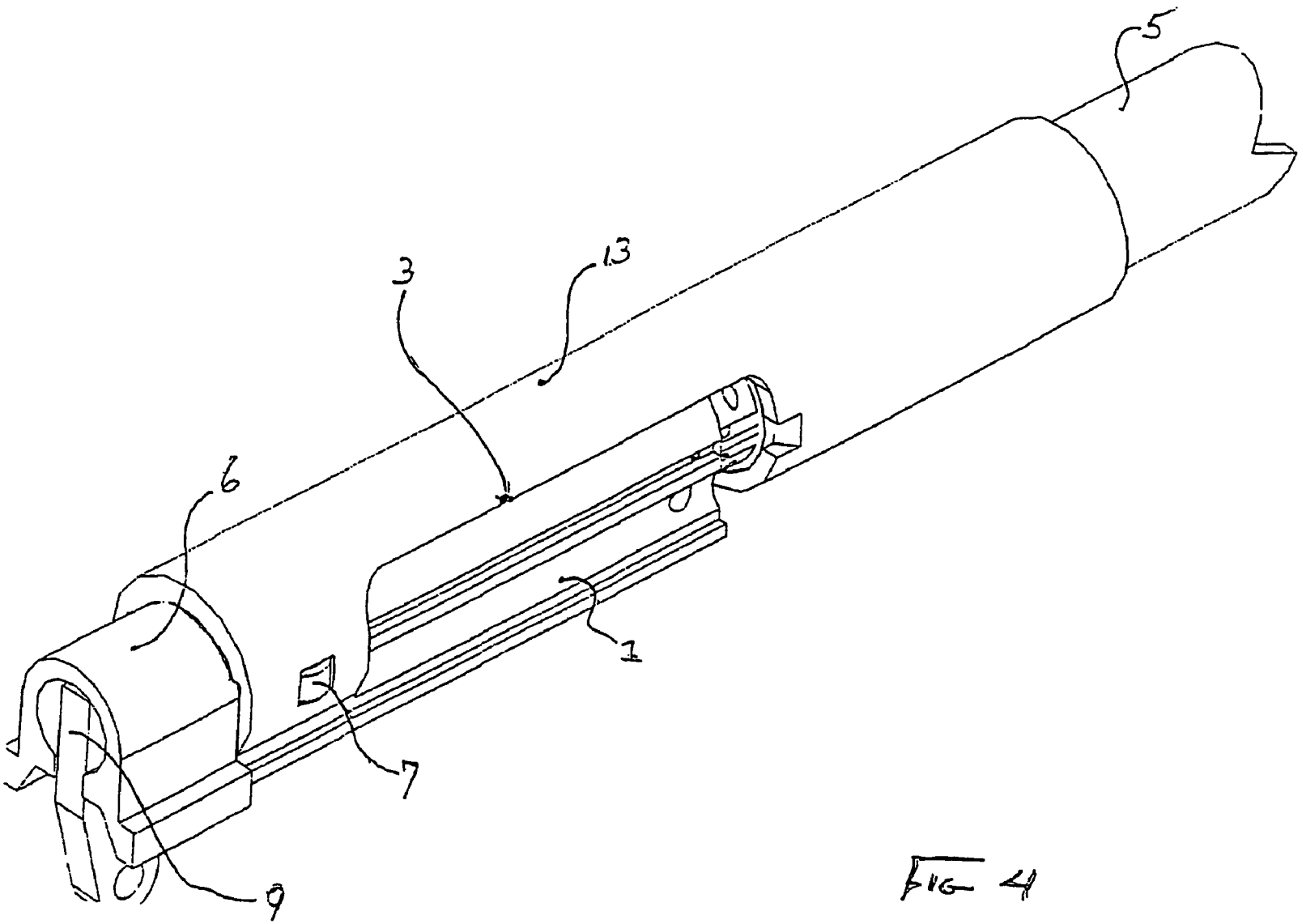
FIG. 4 is a partial perspective view of the action system of the present invention in battery position.

FIG. 4 depicts a partial perspective view of the action system of the present invention in battery position, specifically showing the primary rollers 7 wedged outward by the ramps 11 in the bolt carrier 6 into receiving pocket(s) 22 in the barrel extension 13, and the position of the primary roller-lock mechanism relative to the ejection port 3.

Figure 5:
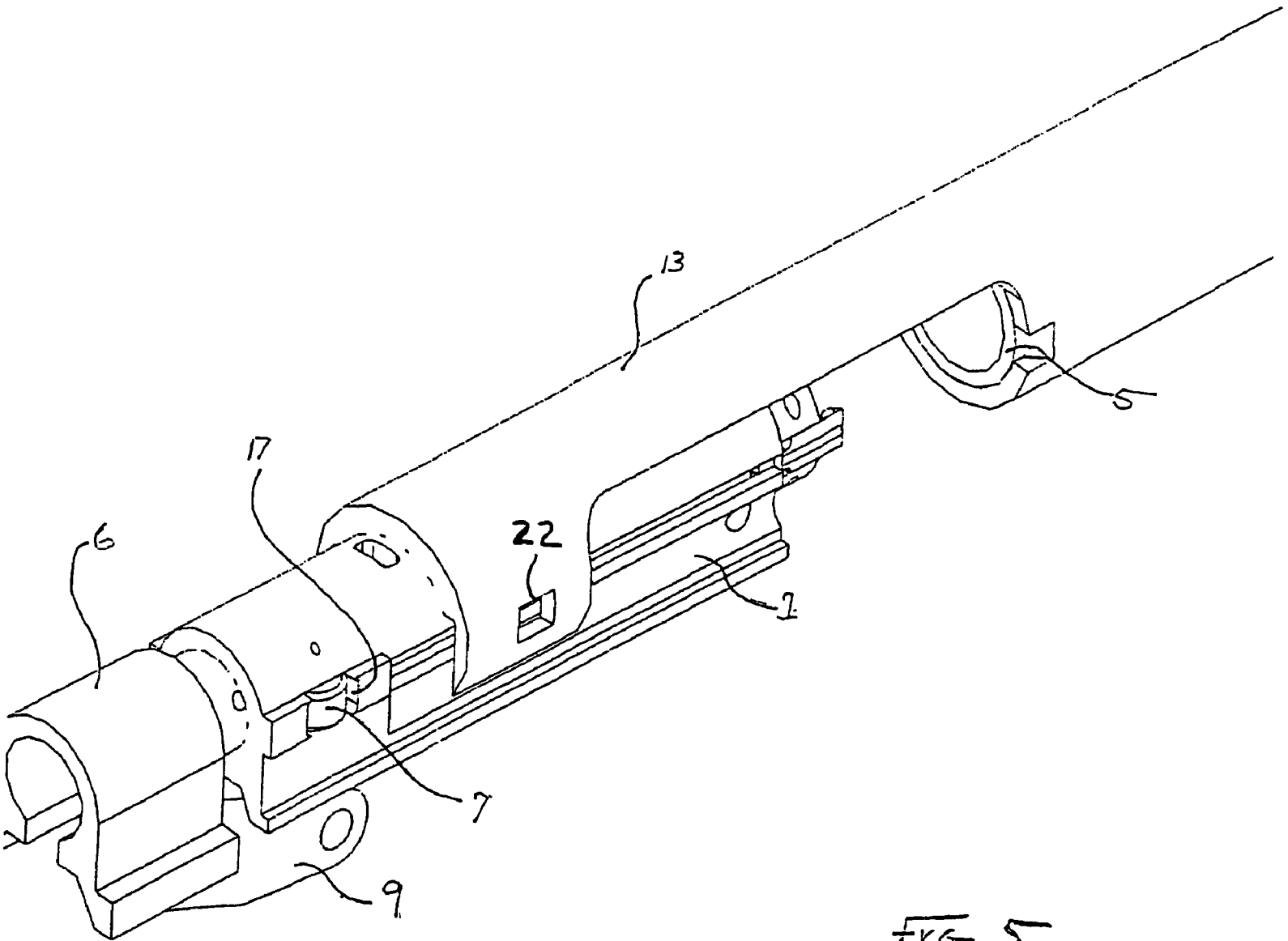
FIG. 5 is a partial perspective view of the action system of the present invention in open position.

FIG. 5 depicts a partial perspective view of the action system of the present invention out of battery position, specifically showing the rollers 7 in the cage 17 in the bolt 1, pinched inward against the ramps in the bolt carrier 6, which is extended rearward relative to the bolt 1.

Figure 8:
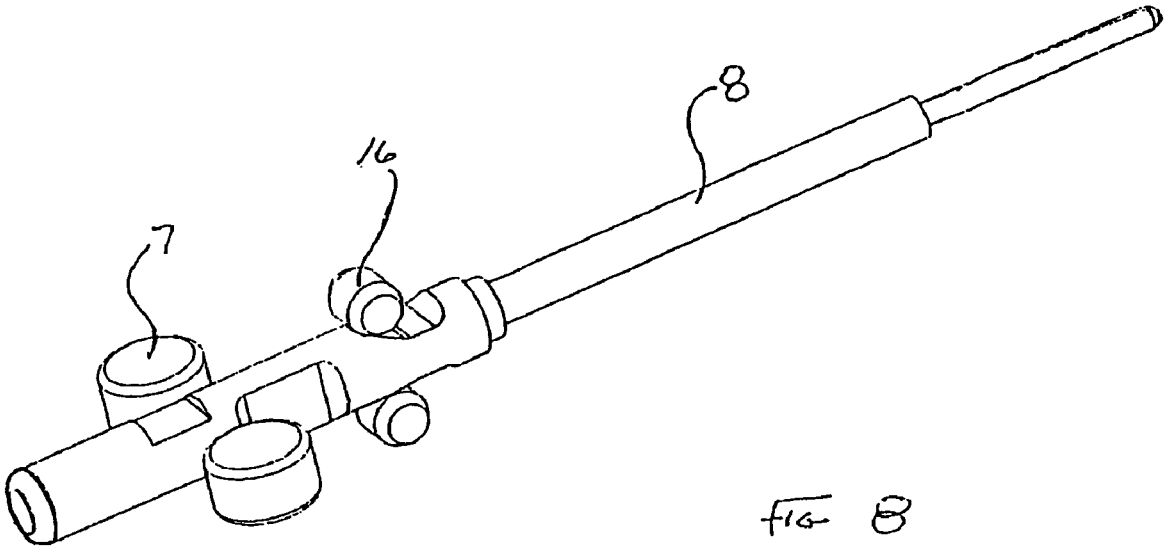

FIG. 8 depicts the relative positions of the primary 7 and secondary 16 rollers to the firing pin 8, which is coaxial with the barrel 5, bolt 1, and bolt carrier 6. It is noted here that the primary and secondary rollers need not necessarily be located in perpendicular planes, or symmetrically opposed about the common centerline, or in a particular forward/rearward orientation, but are so oriented in the preferred embodiment for simplicity and ease of manufacture.

It is to be understood that the present invention preferably utilizes a pair of rollers for the primary roller-lock mechanism, but that a single bearing, e.g., roller, can be utilized to effectively delay the opening of the firing chamber until the explosive pressure within is reduced to a safe level. Similarly, a single bearing or roller can be utilized for the secondary roller-lock mechanism.

It is further to be noted that although the present invention is preferably devised to enable a roller-lock delayed blowback action system for a semi-automatic shotgun, the present invention can easily be employed by one of ordinary skill in the art to firearms other than semi-automatic shotguns.

The linear surface(s) 11, 12 provides a constant, limited range of applied resistant-force to rearward movement of the bolt 1 and/or bolt carrier 6. In other words, if the straight surfaces 11, 12 were angled so as to provide a low amount of resistance—and therefore allow very low-powered ammunition to cycle the firearm's action—a similar amount of resistance would correspondingly be provided to very high-powered ammunition, and thus be insufficient to prevent bulging or fracturing of the firearm. Likewise, if the straight surface(s) 11, 12 were angled so as to initially provide a high amount of resistance—and therefore provide sufficient rearward resistance to the bolt 1 and/or bolt carrier 6 in response to high-powered ammunition—a similar amount of rearward resistance to the bolt 1 and/or bolt carrier 6 would correspondingly be provided in response to low-powered ammunition, and thus unsatisfactorily prolong the delay to cycle the firearm's action, or prevent it altogether.

In reference to the delayed roller-lock system incorporating a linear ramp or surface 11, 12 described above and depicted in FIGS. 1-8, certain modifications are now described that relate directly to the functional aspects of the ramp(s)/surface(s). Namely, the ramp(s)/surface(s) includes an arcuate geometry, e.g., a curvature including a constant or variable radius, that is capable of providing a varied amount of resistance to rearward movement of the bolt 1 and/or bolt carrier 6.

Figure 9:
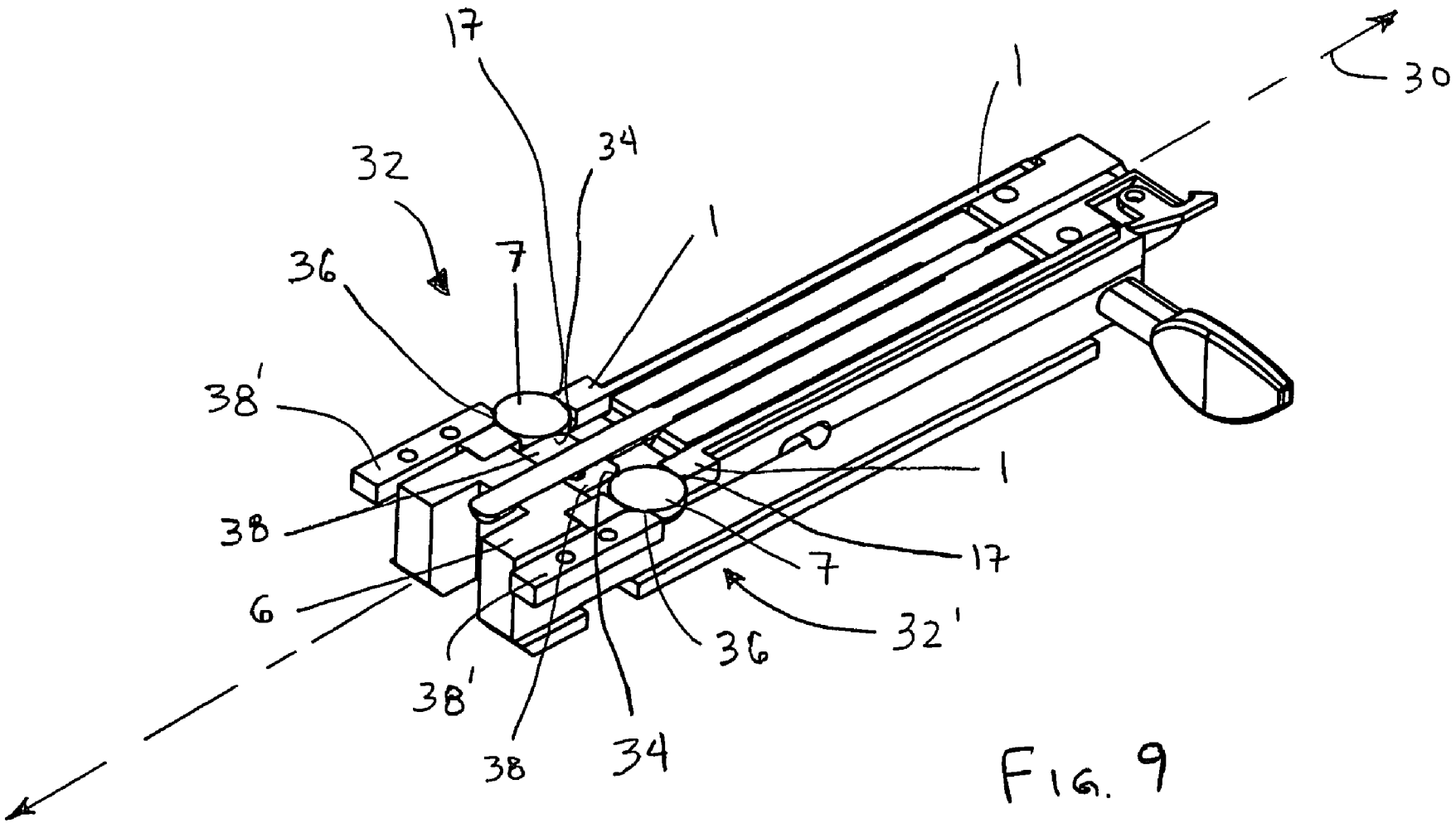
Figure 10:
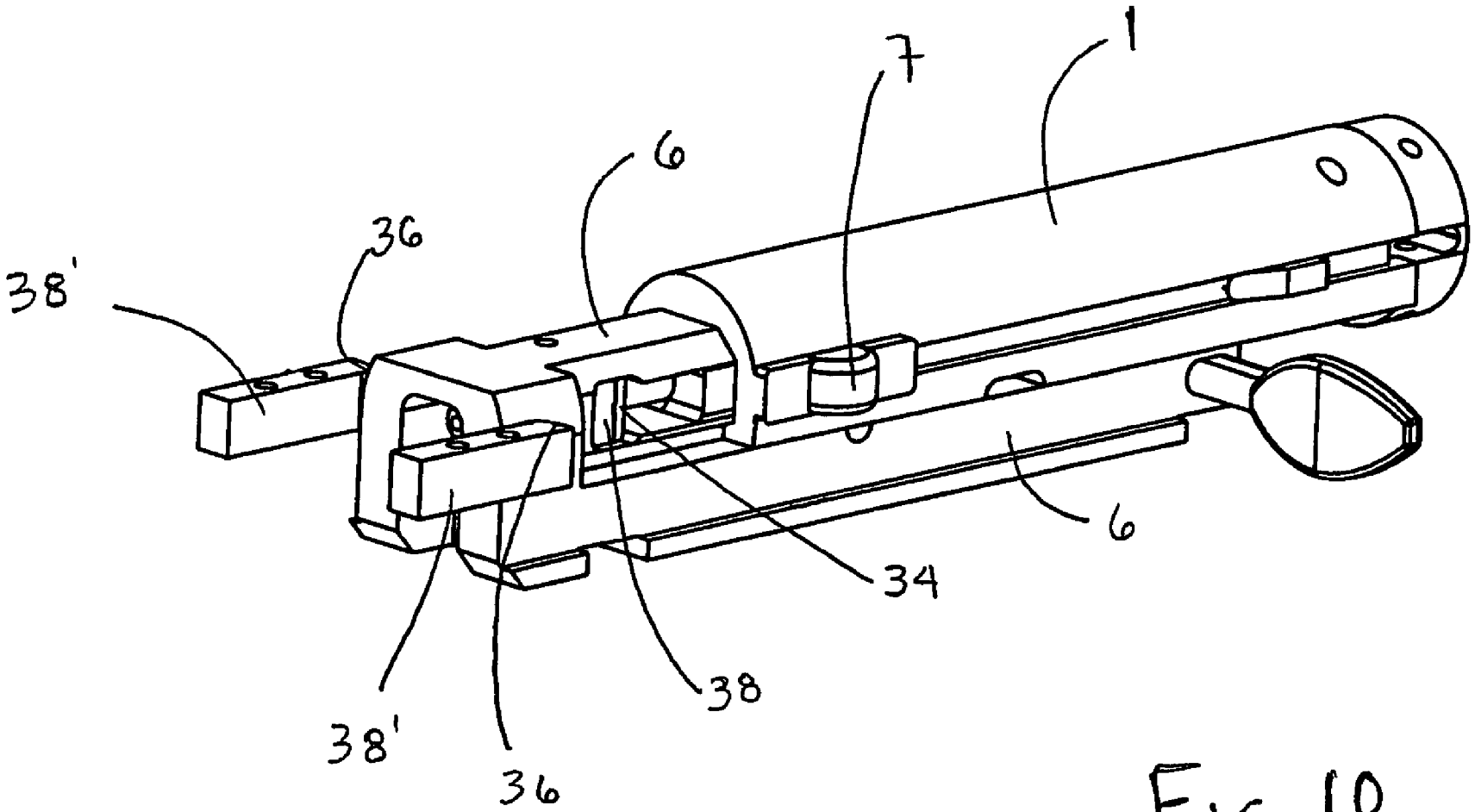
FIG. 10 is a partial perspective view of the alternate embodiment shown in FIG. 9.

FIGS. 9-13 depict an action system for a semi-automatic shotgun including a receiver 2 having an ejection port 3 for expelling an empty cartridge 19 of a fired projectile. As shown in FIGS. 9 and 10, the action system includes a bolt 1 operatively attached to a bolt carrier 6. Both the bolt 1 and the bolt carrier 6 are movable within the receiver 2 and substantially parallel to a longitudinal axis 30 infinitely extending from the firearm's barrel 5. The action system further includes a means for providing an amount of resistance to rearward movement of the bolt 1 and bolt carrier 6. The resistance to the rearward movement of the bolt 1 is provided by a roller-lock assembly 32 including a roller 7 positioned rearward of the ejection port 2 and a pair of surfaces—inner 34 and outer 36—are positioned proximate the roller. In addition, another roller-lock assembly 32' can be symmetrically positioned about the opposing side of the longitudinal axis 30.

Although the inner surface 34 may be a portion of the bolt carrier 6 and the outer surface 36 may be a portion of the receiver 2, it is preferable however that at least one of the inner or outer surfaces is at least a portion of an insert 38, 38'. The inserts 38, 38' may include hardened steel and be removably attached to the receiver 2 or bolt carrier 6. Additionally, it is possible for one insert 38, 38' to contain more than one inner surface 34, or outer surface 36.

Figure 11:
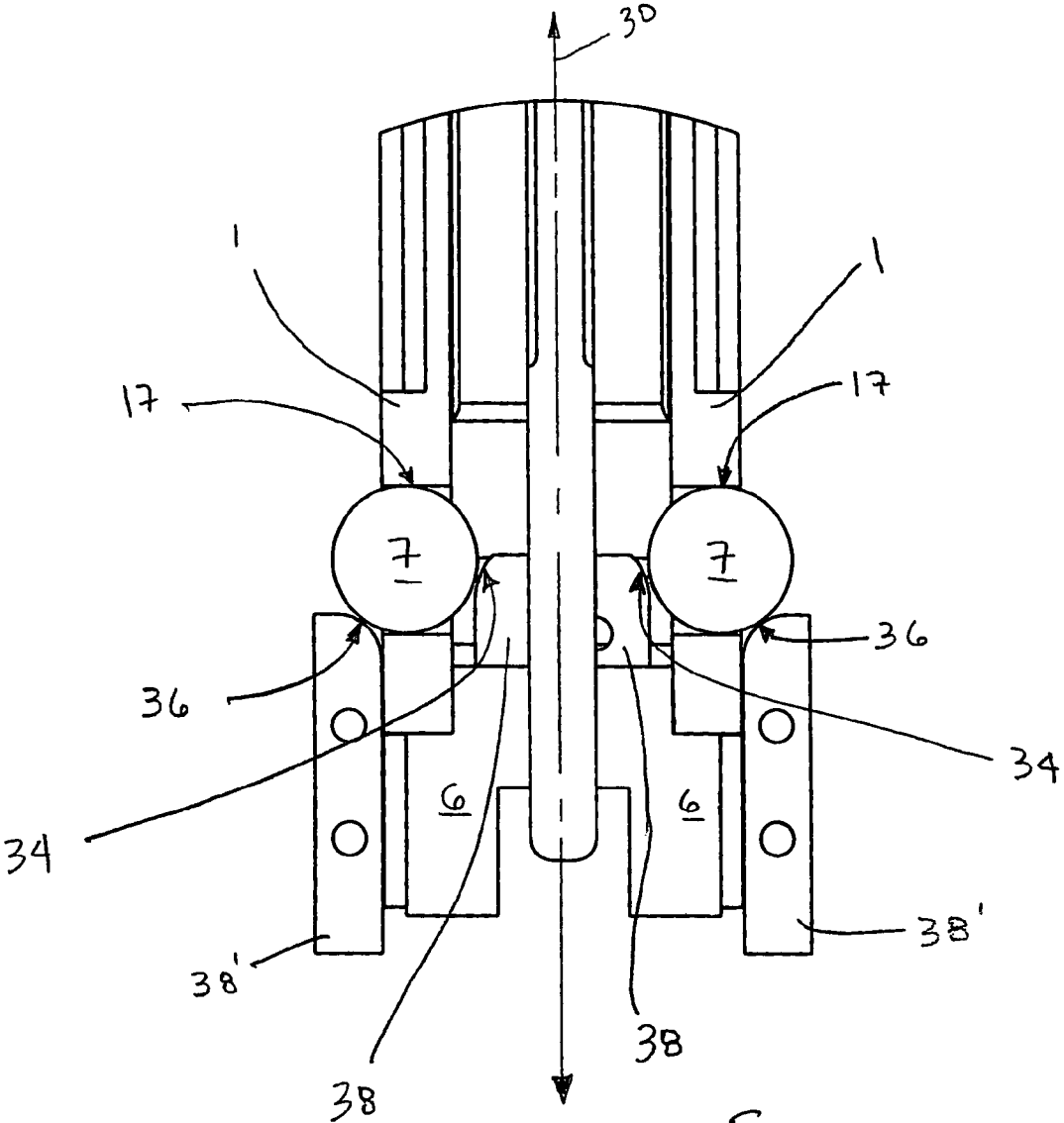
FIG. 11 is a partial cross-section plan view of one aspect of the present invention wherein the firearm is shown in battery position.
Figure 12:
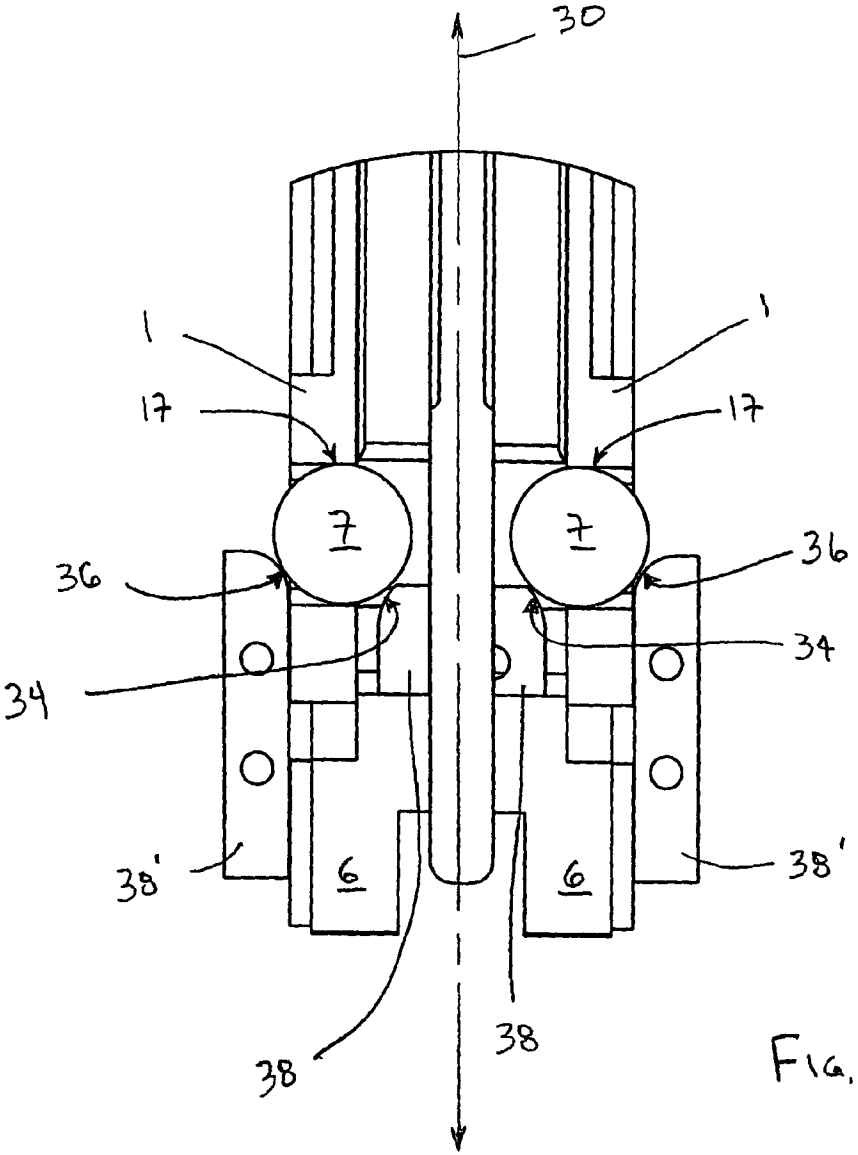
FIG. 12 is a partial cross-section plan view of one aspect of the present invention wherein the firearm is shown in rearward transition.
Figure 13:
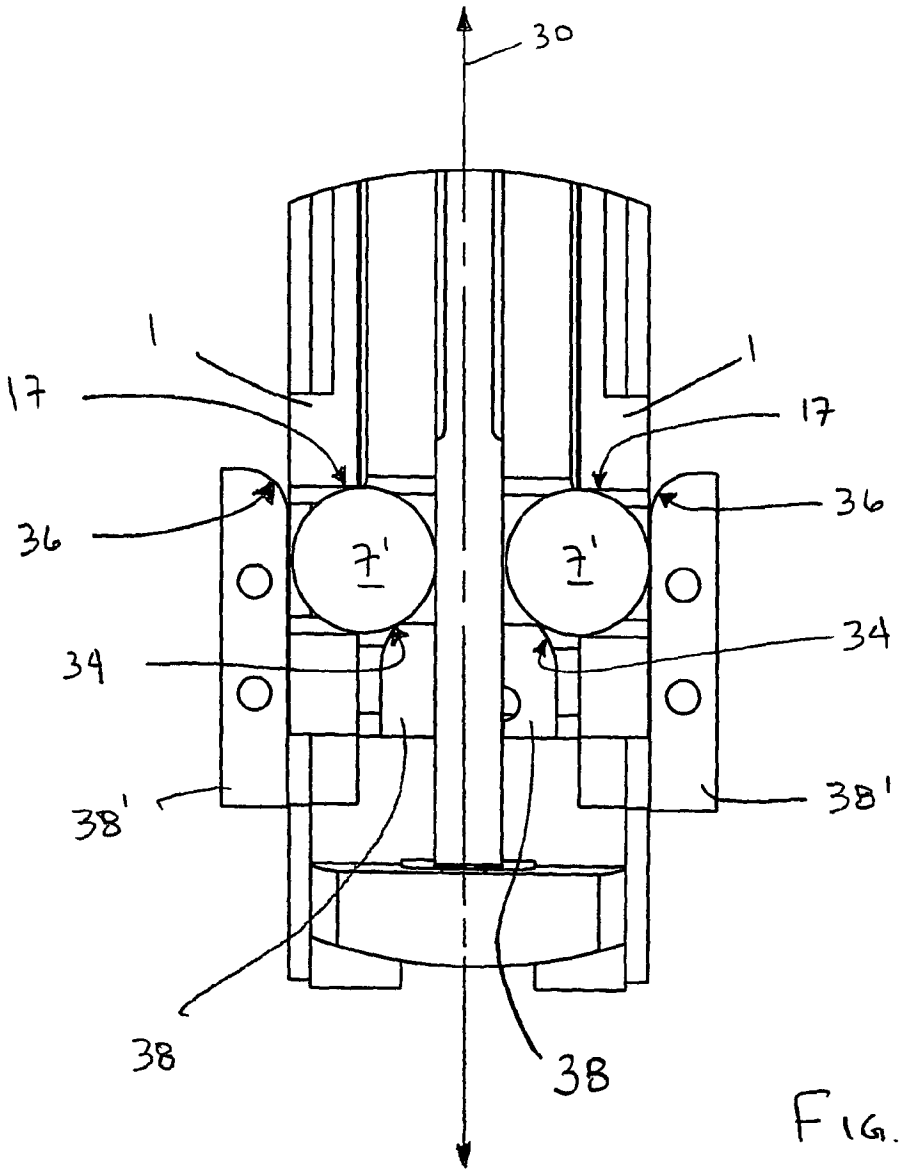
FIG. 13 is a partial cross-section plan view of one aspect of the present invention wherein the firearm is shown near the terminus of its rearward transition; and, FIGS. 14A-14C are partial cross-section plan views depicting the roller-lock assembly's various angles of contact during various positions of the action system.

FIGS. 11-13 depict movement of the rollers 7—substantially contained within the bolt 1 and within a plane perpendicular to the longitudinal axis 30—with respect to the surfaces 34, 36 wherein resistance to rearward movement of the bolt 1 and/or bolt carrier 6 is provided. Initially, rearward movement of the bolt 1 pushes the rollers 7 rearward, i.e., downward with respect to FIG. 11. Upon continued rearward urging by the bolt 1, the rollers 7 impinge upon the inner 34 and outer 36 surfaces of the inserts 38, 38' and eventually slide towards the longitudinal axis 30 (see FIG. 12), further applying pressure to the inner surfaces 34 to urge the bolt carrier 6 rearward (see FIG. 13).

As seen in FIGS. 11-13, inner 34 and outer 36 surfaces include a portion having an arcuate surface for cooperative engagement with the rollers 7. The arcuate surfaces provide an amount of resistance to rearward movement of the bolt 1 and bolt carrier 6. The arcuate surfaces shown in FIGS. 9-13 include a curve having a constant or variable radius. Because the angle of contact $\alpha$, $\beta$ between the rollers 7 and the surfaces 34, 36 changes throughout rearward movement of the rollers, the radius of curvature of the surfaces can be designed in consideration of the amount of resistance desired to be applied to the rearwardly moving bolt 1 and bolt carrier 6.

Figure 14A:
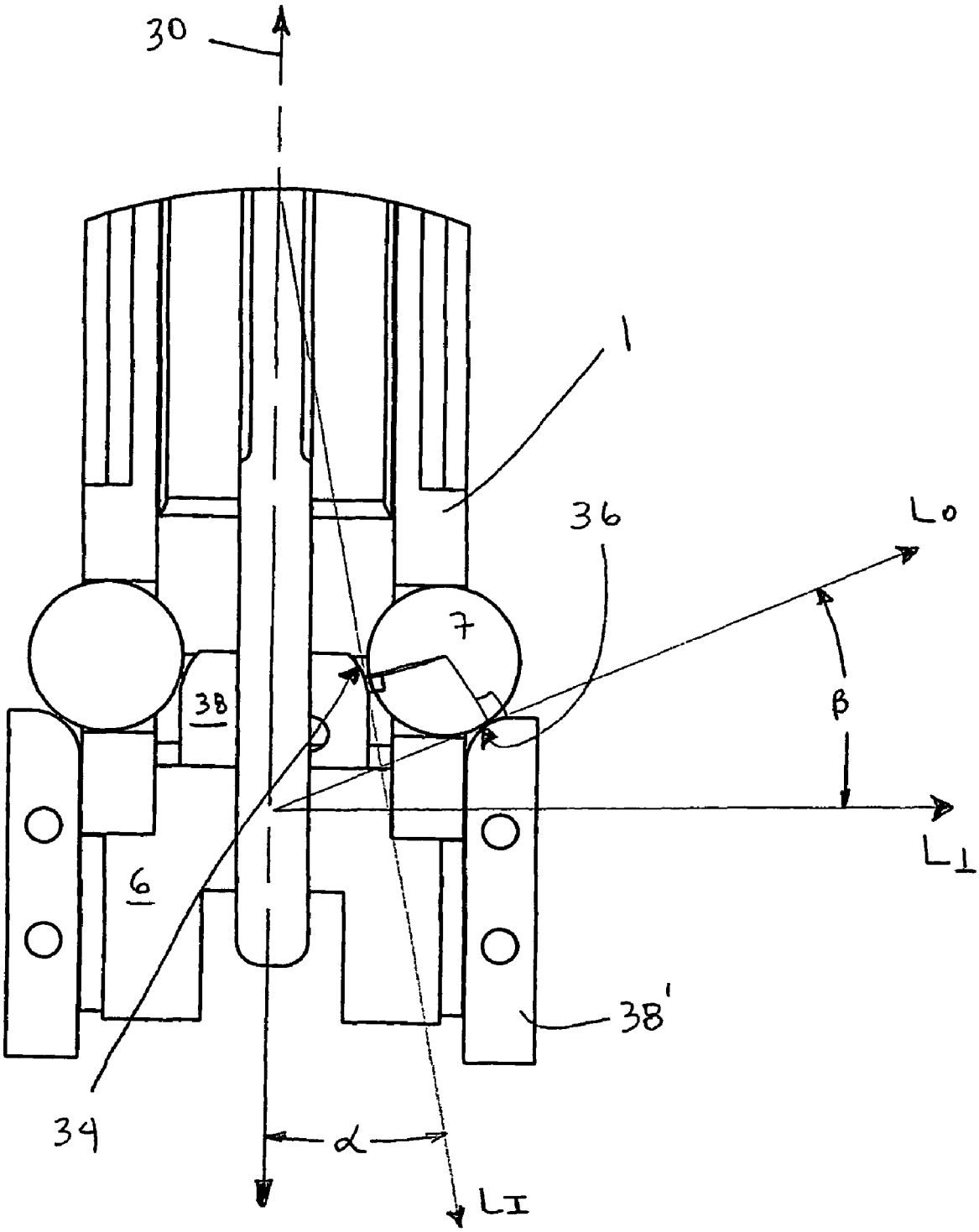
Figure 14B:
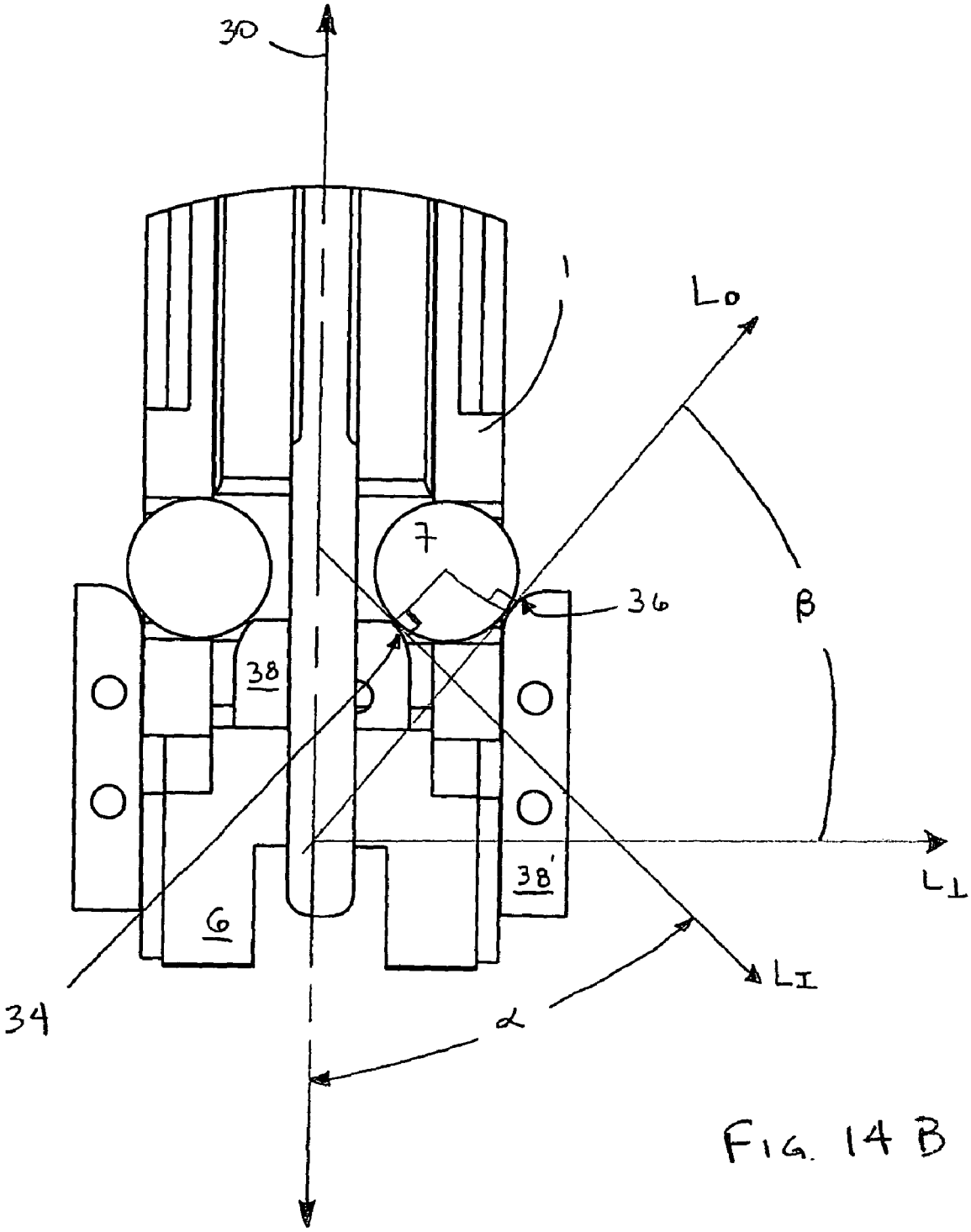
Figure 14C:
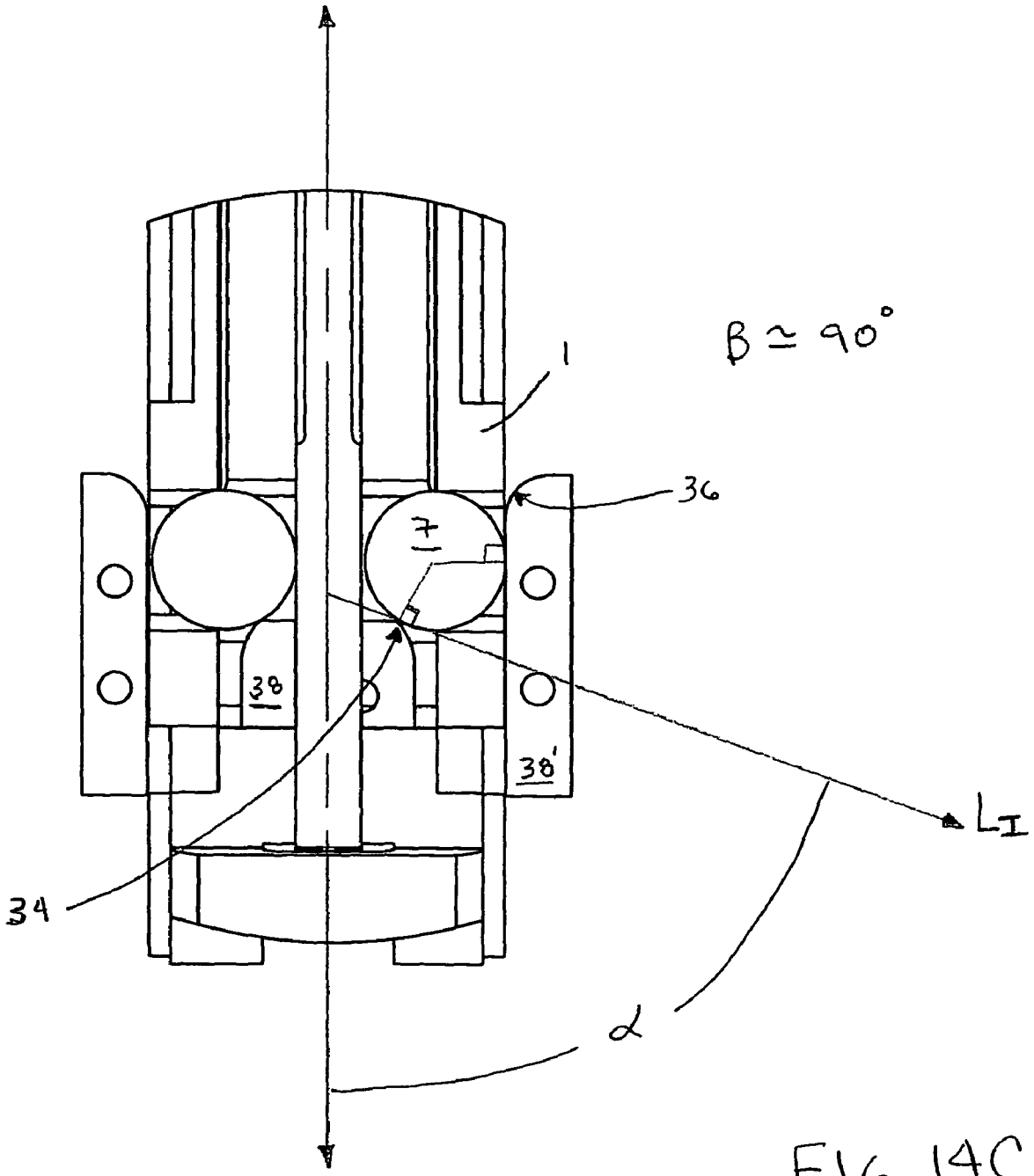

Referring now to FIGS. 14A-14C, the angle of contact a involving the roller 7 and the inner surface 34 is defined between the longitudinal axis 30 and a line $L_1$ tangent to the roller and including the point of contact of the roller and the inner surface. The angle of contact $\beta$ involving the roller 7 and the outer surface 36 is defined between a line $L_O$ tangent to the roller and including the point of contact of the roller and the outer surface, and a line $L_\perp$ extending perpendicular to the longitudinal axis 30 at the intersection of the longitudinal axis and the tangent line $L_O$.

The arcuate geometry of the inner 34 and outer 36 surfaces is capable of providing a variable amount of resistance to the rearward movement of at least the bolt 1 or bolt carrier 6. That is, the curved inner 34 and outer 36 surfaces can initially provide a higher amount of resistance to the rearward movement of the bolt 1 that subsequently decreases, and vice versa. Depending on the desired amount and application of resistance, the radius of curvature of the arcuate surface 34, 36 can be designed accordingly, e.g., the radius can be fixed or variable—radii.

In contrast to the linearly straight ramp 11, 12 utilized in FIGS. 1-8, the arcuate, radiused surfaces 34, 36 include a convex geometry capable of having a continually changing contact angle and providing a variable amount of resistance to the rearward movement of at least the bolt 1 or bolt carrier 6. That is, the radiused surfaces 34, 36 initially provide a higher amount of resistance to the rearward movement of at least the bolt 1 or bolt carrier 6 that subsequently decreases.

Initially providing a greater amount of resistance to the rearward movement of at least the bolt 1 or bolt carrier 6 is beneficial when firing extremely high-powered shotgun ammunition. Similarly, subsequently decreasing the resistance to the rearward movement of at least the bolt 1 or bolt carrier 6 provides the firearm's action system with the ability to cycle low-powered shotgun ammunition.

In FIGS. 9-13, symmetrically opposed hardened steel inserts 38' are fixed in the receiver 2 of the firearm along the path of the bolt 1—substantially parallel with the longitudinal axis 30—which substantially cages the rollers 7 and slides over the bolt carrier 6 in which is fixed a hardened steel insert 34 upon which the rollers impinge. When the bolt 1 is in battery—depicted in FIG. 11—the radiused inner surfaces 34 of the insert 38 in the bolt carrier 6 impinge outwardly on the rollers 7, which in turn impinge on the radiused outer surfaces 36 of the inserts 38' fixed in the receiver 2 and on the flat surfaces 17 of the bolt 1, which holds the shotgun shell in the chamber of the firearm. When the shell is fired, the bolt 1 is forced rearward, applying force from the flat surface 17 to the roller 7, which applies force to the outer surfaces 36 of the insert 38' attached to the receiver 2 and the inner surfaces 34 of the insert 38 attached to the bolt carrier 6 until the bolt carrier is accelerated rearward as depicted in FIGS. 12 and 13, in which the rearward motion of the bolt 1 is no longer resisted or delayed and the bolt opens to eject the fired shell and cycle the action.

As depicted in FIG. 11, the initial resistance to the applied force is dependant on the contact angles $\alpha$, $\beta$ at the points of contact between the rollers 7 and the radiused surfaces 34, 36 of the inserts 38, 38'. The resistance is inversely proportional to the angles of contact α, β. That is, as the angles of contact α, β decrease, the resistance increases; and as the bolt carrier 6 begins to move, the angles of contact α, β increase and the resistance decreases. Thus, the arcuate surfaces 34, 36—in combination with the rollers 7—provide the firearm with the ability to safely and reliably cycle the action system in response to both very high powered and very low powered ammunition, i.e., providing a sufficient initial resistance that decreases rapidly. As such, the present invention provides firearms, e.g., shotguns, utilizing a delayed roller-lock action system with the ability to operate safely and reliably over a wide range of ammunition.

It is also to be understood that the present invention may be embodied in other specific forms without departing from the spirit or central characteristics thereof. The present embodiments, therefore, are to be considered in all respects as illustrative and not restrictive, and the present invention is not to be limited to the details provided herein. While specific embodiments have been illustrated and described, numerous modification come to mind without significantly departing form the characteristics of the present invention and the scope of protection is only limited by the scope of the accompanying claims.

What is claimed is:

1. A roller delayed blowback action system for a semi-automatic shotgun having a receiver including an ejection port for expelling an empty cartridge of a fired projectile, the roller delayed blowback action system comprising:

the receiver including a pair of inserts—a first insert and a second insert—extending within the receiver;

a bolt carrier including a third insert, the bolt carrier being operatively attached to a bolt, wherein the bolt and the bolt carrier being movable within the receiver and substantially parallel to a longitudinal axis;

a pair of rollers—a first roller and a second roller—positioned rearward of the ejection port, the pair of rollers being substantially contained within the bolt and proximate the third insert, the first roller being proximate the first insert and the third insert and the second roller being proximate the second insert and the third insert, wherein operative cooperation between the pair of rollers and the first, second, and third inserts delays movement of the bolt and bolt carrier subsequent to firing of the shotgun without locking movement of the bolt or the bolt carrier.

2. The roller delayed blowback action system of claim 1, wherein each insert includes a surface.

3. The roller delayed blowback action system of claim 2, wherein each of the surfaces includes an arcuate geometry such that a plurality of contact angles between the first or second roller and the surface of its respective proximate inserts cooperate to provide a variable resistance to rearward movement of the bolt or bolt carrier.

4. The roller delayed blowback action system of claim 1, wherein each insert is removably attached.

5. The roller delayed blowback action system of claim 1, wherein each insert includes hardened steel.

6. The roller delayed blowback action system of claim 1, wherein the pair of rollers are slideably moveable within a plane substantially perpendicular to the longitudinal axis.

7. A roller delayed blowback action system for a semi-automatic shotgun having a receiver including an ejection port for expelling an empty cartridge of a fired projectile, the roller delayed blowback action system comprising:

a bolt operatively attached to a bolt carrier, the bolt and the bolt carrier being movable within the receiver and substantially parallel to a longitudinal axis;

a roller-delay assembly comprising:

a pair of surfaces—a first surface and a second surface—extending from within the receiver;

a third surface extending from the bolt carrier; and, a pair of rollers—a first roller and a second roller—positioned rearward of the ejection port and substantially contained within the bolt, the first roller proximate the first and the third surfaces, and the second roller proximate the second and third surfaces, wherein operative cooperation between the pair of rollers and the first, second, and third surfaces delays movement of the bolt and bolt carrier subsequent to firing of the shotgun without locking movement of the bolt or the bolt carrier.

8. The action system of claim 7, wherein each of the surfaces includes an arcuate geometry.

9. The action system of claim 8, wherein the arcuate geometry is a curve facilitating a variable resistance to rearward movement of the bolt carrier and/or bolt.

10. The action system of claim 8, wherein the arcuate geometry is a curve facilitating a decreasing resistance to rearward movement of the bolt carrier and/or bolt.

11. The action system of claim 7, wherein the first surface is integral to a first insert operatively attached to the receiver and the second surface is integral to a second insert operatively attached to the receiver.

12. The action system of claim 11, wherein the first and second inserts are removably attached within the receiver.

13. The action system of claim 7, wherein the third surface is integral to a third insert operatively attached to the bolt carrier.

14. The action system of claim 13, wherein the third insert is removably attached to the bolt carrier.

* * * * *